US008550715B2

(12) United States Patent
Anzini et al.

(10) Patent No.: US 8,550,715 B2
(45) Date of Patent: Oct. 8, 2013

(54) ZIPPER WITH INTERMESHING FLANGE CONTOURS CROSS-REFERENCE TO RELATED APPLICATIONS

(75) Inventors: David J. Anzini, Middletown, NY (US); Charles G. Greco, Bardonia, NY (US); Glyn Russell, New City, NY (US)

(73) Assignee: Illinois Tool Works Inc., Glenview, IL (US)

( * ) Notice: Subject to any disclaimer, the term of this patent is extended or adjusted under 35 U.S.C. 154(b) by 209 days.

(21) Appl. No.: 12/951,754

(22) Filed: Nov. 22, 2010

(65) Prior Publication Data

US 2011/0176751 A1 Jul. 21, 2011

Related U.S. Application Data

(60) Provisional application No. 61/296,123, filed on Jan. 19, 2010.

(51) Int. Cl.
*B65D 33/16* (2006.01)
*A44B 1/04* (2006.01)

(52) U.S. Cl.
USPC ..... 383/63; 383/59; 383/65; 24/399; 24/400; 24/DIG. 51

(58) Field of Classification Search
USPC ..... 383/59, 63, 65; 24/585.12, 399, 24/400, DIG. 50, DIG. 51
See application file for complete search history.

(56) References Cited

U.S. PATENT DOCUMENTS

| | | | | |
|---|---|---|---|---|
| 5,573,614 | A | 11/1996 | Tilman | |
| 5,664,303 | A | 9/1997 | Johnson | |
| 6,167,597 | B1 * | 1/2001 | Malin | 24/585.1 |
| 6,185,796 | B1 * | 2/2001 | Ausnit | 24/585.1 |
| 6,481,890 | B1 * | 11/2002 | VandenHeuvel | 383/64 |
| 6,854,886 | B2 * | 2/2005 | Piechocki et al. | 383/59 |
| 6,954,969 | B1 | 10/2005 | Sprehe | |
| 7,241,046 | B2 * | 7/2007 | Piechocki et al. | 383/59 |
| 7,340,807 | B2 * | 3/2008 | Dais et al. | 24/443 |
| 7,886,412 | B2 * | 2/2011 | Dais et al. | 24/585.12 |
| 8,176,604 | B2 * | 5/2012 | Dais et al. | 24/585.12 |
| 8,196,269 | B2 * | 6/2012 | Dais et al. | 24/400 |
| 2003/0177619 | A1 * | 9/2003 | Cisek | 24/585.12 |
| 2007/0294866 | A1 * | 12/2007 | Anzini et al. | 24/399 |
| 2009/0300891 | A1 | 12/2009 | Nanba | |

* cited by examiner

*Primary Examiner* — Jes F Pascua
(74) *Attorney, Agent, or Firm* — McCarter & English, LLP

(57) ABSTRACT

A reclosable zipper is illustrated, which includes a first profile having a first interlocking element, a first consumer side flange with a first consumer side intermeshing contour and a first product side flange with a first product side intermeshing contour. The zipper includes a second profile which includes a second interlocking element, a second consumer side flange with a second consumer side intermeshing contour, and a second product side flange with a second product side intermeshing contour. The first and second consumer side intermeshing contours are complementary intermeshing contours and the first and second product side intermeshing contours are complementary intermeshing contours. As a result, when the interlocking elements are engaged, the first and second consumer side intermeshing contours are capable of intermeshing and the first and second product side intermeshing contours are capable of intermeshing.

16 Claims, 2 Drawing Sheets

ZIPPER WITH INTERMESHING FLANGE CONTOURS CROSS-REFERENCE TO RELATED APPLICATIONS

CROSS-REFERENCE TO RELATED APPLICATIONS

This application claims priority to U.S. Provisional Patent Application No. 61/296,123, filed on Jan. 19, 2010 on behalf of Anzini, et. al., the disclosure of which is incorporated herein by reference in its entirety.

BACKGROUND OF THE DISCLOSED EMBODIMENTS

1. Field of the Disclosed Embodiments

The disclosed embodiments relate to a zipper having contours on consumer side and product side flanges which are capable of intermeshing at crush locations at the bag side seals.

2. Description of the Related Art

With the push for more economical packaging solutions, web laminate films used for forming bag panels are moving toward thinner gauge structures. This presents challenges when placing a reclosable zipper in a bag. Specifically, crushing the zipper when forming the bag side seals can cause tearing of the web layers. In a sealed bag structure, the web tearing may result in additional cracking and tearing, creating an appearance that is not aesthetically pleasing.

Examination of the problem has revealed that while being crushed, the zipper profiles spread outwardly in a bag height-wise direction. This spreading gouges the web film, effectively plowing a gap into the bag at the bag side seals.

BRIEF SUMMARY OF THE DISCLOSED EMBODIMENTS

In view of the disclosed issues with crushing the zipper when forming bag side seals, a reclosable zipper is illustrated, which includes a first profile having a first interlocking element, a first consumer side flange with a first consumer side intermeshing contour and a first product side flange with a first product side intermeshing contour. The zipper includes a second profile which includes a second interlocking element, a second consumer side flange with a second consumer side intermeshing contour, and a second product side flange with a second product side intermeshing contour. The first and second consumer side intermeshing contours are complementary intermeshing contours and the first and second product side intermeshing contours are complementary intermeshing contours. As a result, when the interlocking elements are crushed together during formation of bag side seals, the first and second consumer side intermeshing contours are capable of intermeshing and the first and second product side intermeshing contours are capable of intermeshing, thereby constraining expansion and movement of the zipper elements so as to avoid gouging of the web film.

BRIEF DESCRIPTION OF THE FIGURES

Certain embodiments of the invention will be described through the use of the accompanying drawings, which are not to be considered as limiting, and in which.

DETAILED DESCRIPTION OF THE DISCLOSED EMBODIMENTS

Figure 1:
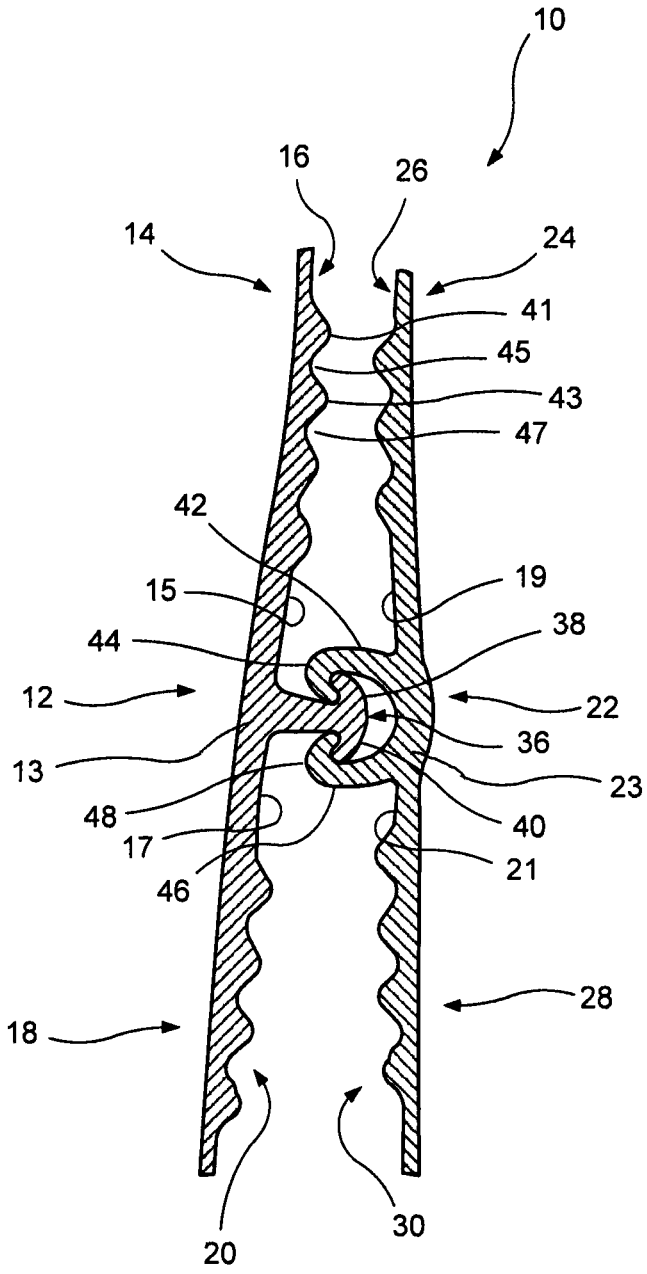
FIG. 1 illustrates first and second zipper profiles with respective intermeshing contours in an un-intermeshed configuration.

Turning to FIG. 1, a cross section of a reclosable zipper 10 is disclosed. The zipper 10 includes a first profile 12 which includes a first interlocking element 13, a first consumer side flange 14 with a first consumer side intermeshing contour 16 and a first product side flange 18 with a first product side intermeshing contour 20. The zipper 10 also includes a second profile 22 which includes a second interlocking element 23, a second consumer side flange 24 with a second consumer side intermeshing contour 26 and a second product side flange 28 with a second product side intermeshing contour 30. The first and second consumer side intermeshing contours 16, 26 are complementary intermeshing contours and the first and second product side intermeshing contours 20, 30 are complementary intermeshing contours. Due to these complementary intermeshing contours, when the interlocking elements 13, 23 are engaged, the first and second consumer side intermeshing contours 16, 26 are opposing and capable of intermeshing (that is, the complementary undulations engage with or against each other), and the first and second product side intermeshing contours 20, 30 are opposing and capable of intermeshing. The intermeshing of the profile contours during formation of bag side seals constrains movement and expansion of the zipper elements 13, 23, thereby preventing gouging and cracking of bag web panels. As is known in the art, the "consumer" side is the side of the zipper oriented toward the consumer (away from the products) and the "product side" is the side of the zipper oriented toward the product in the reclosable package or similar structure.

The width of the first and second profiles 12, 22, measured in the bag height-wise direction, is substantially the same. In addition, as compared with a width of the first and second interlocking member 13, 23, also measured in the bag-height-wise direction, the width of the first and second profiles 12, 22 is substantially larger. Further, the first and second interlocking elements 13, 23 are substantially centrally disposed along the width of respective first and second profiles 12, 22. The first and second interlocking elements 13, 23 are, mass-wise, substantially evenly distributed in along the width of respective first and second profiles 12, 22. Such proportions and weight distribution enable the zipper elements 13, 23 to fuse evenly, at a constant rate, when forming the bag side seals, avoiding the presence of a mass of material that could shift in an uneven fashion, gouging the web film. Moreover, the flanges in the first and second profiles 12, 22 have a substantially same thickness. This assists in evenly distributing pressure created from crushing the profiles 12, 22 when forming the bag side seals as well as supporting the weight of the profiles 12, 22 along the zipper 10.

The first interlocking element 13 is a male zipper element and the second interlocking element 23 is a female zipper element. The male zipper element 13 has a central rib 36 with a consumer side hook 38 and a product side hook 40. On the other hand, the female element 23 includes a consumer side leg 42 with a consumer side foot 44 and a product side leg 46 with a product side foot 48. When the zipper elements 13, 23 are engaged as illustrated in FIG. 1, for example, mid-span in a bag width-wise direction, the feet 44, 48 engage the hooks 38, 40 to prevent accidental disengagement.

Moreover, the first consumer side intermeshing contour 16 and the first product side intermeshing contour 20 are symmetric about the first interlocking member 13. Due to such symmetry, the above noted same size and complementary intermeshing characteristics of the intermeshing contours in the first and second profiles 12, 22, further discussion of the characteristics of the first consumer side intermeshing contour 16 is sufficient to disclose the characteristics of the intermeshing contours in each of the flanges on both profiles 12, 22.

Figure 2:
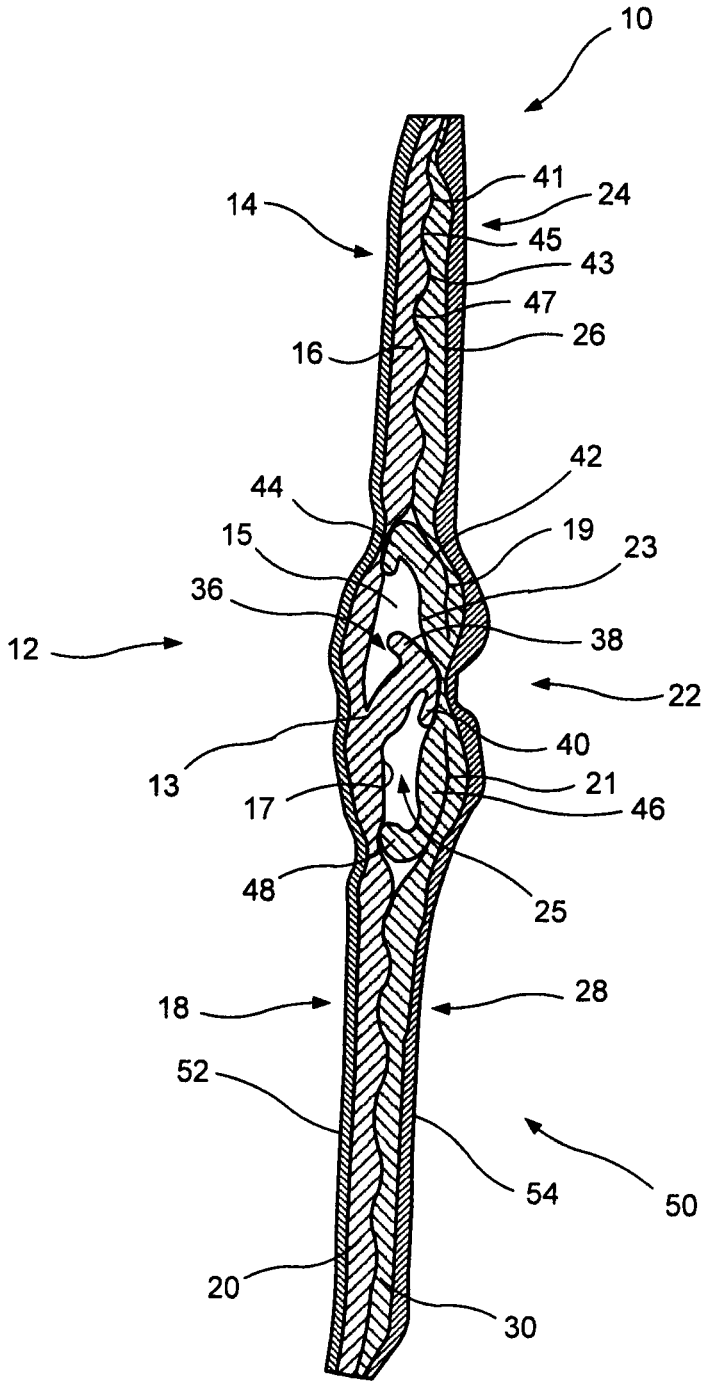
FIG. 2 illustrates a portion of a bag with the zipper profiles, wherein a bag side seal is in the process of being formed, and the intermeshing contours in the zipper profiles have intermeshed while in the process of being crushed.

The first consumer side intermeshing contour 16 spans a substantial portion of the width of the first consumer side flange 14. A first undulation-free region 15 is provided on the first consumer side flange 14, between the first interlocking element 13 and the first consumer side intermeshing contour 16. With similar undulation-free regions on all flanges, amounting to four such undulation-free regions in the zipper 10, as illustrated in FIG. 2, the combined effect limits the spreading of the zipper elements 13, 23 along the profile width when forming bag side seals.

More specifically, in addition to the first consumer side undulation-free region 15, the zipper 10 includes first product side undulation-free region 17 on the first product side flange 18, between the first interlocking element 13 and the first product side intermeshing contour 20. A second consumer side undulation-free region 19 is on the second consumer side flange 24, between the second interlocking element 23 and the second consumer side intermeshing contour 26. A second product side undulation-free 21 region on the second product side flange 28, between the second interlocking 23 element and the second product side intermeshing contour 30.

When the profiles 12, 22, are compressed together, a zipper compression cavity 25 (see FIG. 2) is created between the juxtaposed undulation-free regions 15, 17, 19 and 21. The zipper elements 13, 23 are contained within the zipper compression cavity 25 during crushing compression of the zipper profiles 12, 22. A maximum compression of the interlocking elements 13, 23 along a profile width is defined by the span of the zipper compression cavity 25.

The first consumer side intermeshing contour 16 is an undulating contour. More specifically, the first consumer side intermeshing contour 16 is, for example, a sinusoidal waveform and, for example, a triangular waveform, having a substantially constant wavelength and/or a substantially constant wave height. In addition, regarding the orientation of the consumer side intermeshing contour 16, adjacent crests and troughs are spaced from each other along the profile width. Such is illustrated in the first consumer side intermeshing contour 16 with, for example, the location of a first crest 41 as compared with a second crest 43 and a first trough 45 as compared with a second trough 47. As a result of this configuration, the identified troughs are between the identified crests. Moreover, each of the crests and troughs for the consumer side intermeshing contour 16 longitudinally extends in a bag width-wise direction along the zipper 10. Moreover, in some applications, it may be desirable to use a waveform on the consumer side which is different from the waveform on the product side.

Regarding the complementary nature of the opposing intermeshing contours, the intermeshing contours in the second profile 22 are shifted or staggered in a bag height-wise direction relative to the intermeshing contours in the first profile 12. From this shift, as illustrated in FIG. 2, when the first consumer side interlocking element 13 is positioned against the second consumer side interlocking element 23, crests and troughs in the first consumer side intermeshing contour 16 are capable of intermeshing with respective troughs and crests in the second consumer side intermeshing contour 26 when forming bag side seals. In addition, while not illustrated in FIG. 1, some embodiments may include a nub or similar structure on the exterior of the consumer side flanges 14, 24.

Regarding FIG. 2, the figure illustrates a cross section of a portion of a bag 50 fitted with the zipper 10 at the location of the zipper profiles 12, 22. In the figure, a bag side seal is in the process of being formed, and the intermeshing contours in the profiles 12, 22 have intermeshed while in the process of being crushed together. However, the zipper elements 13, 23, while spread out in a bag height-wise direction from applied pressure, have not fused.

The bag 50 has a first bag panel 52 disposed on an exterior side of the first profile 12 and a second bag panel 54 disposed on an exterior side of the second profile 22. A product side pouch (not illustrated) extends away from the zipper 10 in a bag height-wise direction. In addition, the first and second profiles 12, 22 are thicker than respective first and second bag panels 52, 54. From this difference in thickness, web film gouging is further circumvented when forming the bag side seals by evenly disbursing in the thicker profiles 12, 22 pressure created when crushing the flanges and zipper elements 13, 23.

At the location of the illustrated bag side seal, crests and troughs in the first profile 12 are intermeshed with respective troughs and crests in the second profile 22. Such intermeshing is due to crushing pressure exerted along the profile widths during formation of the bag side seal in the first and second bag panels 52, 54. During formation of the illustrated bag side seal, the limitation of spreading of the zipper elements 13, 23 within the profile widths due to the undulation-free regions in the profiles 12, 22, discussed above, minimizes stretching of the web in this area, avoiding cracking and tearing of the web film.

As a result of the above structure, zippers can be used on lighter weight laminate web films than utilized in prior art zipper manufacturing processes. In addition, there is a reduced concern for gouging or fracturing the web films at the location of the bag side seals when using relatively thinner and sensitive films.

The present disclosed embodiments elements may be configured in other specific forms without departing from the spirit or essential characteristics identified herein. The described embodiments are in all respects only as illustrative and not as restrictive. The scope of the embodiments are, therefore, indicated by the appended claims and their combination in whole or in part rather than by the foregoing description. All changes that come within the meaning and range of equivalency of the claims are to be embraced within their scope.

We claim:

1. A reclosable zipper comprising:

a first profile which includes a first interlocking element, a first consumer side flange with an inwardly facing first consumer side intermeshing contour and an outwardly facing first consumer side flat contour, a first product side flange with an inwardly facing first product side intermeshing contour and an outwardly facing first product side flat contour; and a second profile which includes a second interlocking element, a second consumer side flange with an inwardly facing second consumer side intermeshing contour and an outwardly facing second consumer side flat contour, a second product side flange with an inwardly facing second product side intermeshing contour and an outwardly facing second product side flat contour;

wherein the first and second consumer side intermeshing contours are complementary intermeshing contours and the first and second product side intermeshing contours are complementary intermeshing contours so that when the interlocking elements are engaged, the first and second consumer side intermeshing contours are opposing and capable of intermeshing and the first and second product side intermeshing contours are opposing and capable of intermeshing thereby constraining movement of the first and second interlocking elements during subsequent sealing operations;

a first consumer side undulation-free region on the first consumer side flange, between the first interlocking element and the first product side intermeshing contour;

a first product side undulation-free region on the first product side flange, between the first interlocking element and the first product side intermeshing contour;

a second consumer side undulation-free region on the second consumer side flange, between the second interlocking element and the second consumer side intermeshing contour; and a second product side undulation-free region on the second product side flange, between the second interlocking element and the second product side intermeshing contour;

wherein the undulation-free regions define a zipper compression cavity when the profiles are compressed together, and the zipper elements are contained within the zipper compression cavity during crushing compression of the zipper profiles;

wherein a maximum compression of the interlocking elements along a profile width is defined by the span of the zipper compression cavity.

2. The reclosable zipper of claim 1, where the first and second profiles have substantially same width.

3. The reclosable zipper of claim 1, where the first and second profiles have a substantially larger width than the first and second interlocking elements.

4. The reclosable zipper of claim 1, where the first and second interlocking elements are substantially centrally disposed along a width of respective first and second profiles.

5. The reclosable zipper of claim 1, where the first and second interlocking elements are substantially evenly distributed along a width of respective first and second profiles.

6. The reclosable zipper of claim 1, where the first interlocking element is a male zipper element and the second interlocking element is a female zipper element.

7. The reclosable zipper of claim 1, where the first consumer side intermeshing contour and the first product side intermeshing contour are symmetric about the first interlocking element.

8. The reclosable zipper of claim 1, where the first consumer side intermeshing contour spans a substantial portion of a width of the first consumer side flange.

9. The reclosable zipper of claim 1, including:

a first consumer side undulation-free region on the first consumer side flange, between the first interlocking element and the first product side intermeshing contour;

a first product side undulation-free region on the first product side flange, between the first interlocking element and the first product side intermeshing contour;

a second consumer side undulation-free region on the second consumer side flange, between the second interlocking element and the second consumer side intermeshing contour; and a second product side undulation-free region on the second product side flange, between the second interlocking element and the second product side intermeshing contour.

10. The reclosable zipper of claim 1, where the first consumer side intermeshing contour is a sinusoidal waveform.

11. The reclosable zipper of claim 1, wherein the first consumer side intermeshing contour has a substantially constant wavelength and/or substantially constant wave height.

12. The reclosable zipper of claim 1, wherein adjacent crests and troughs for the consumer side intermeshing contour are spaced from each other along the profile widths.

13. The reclosable zipper of claim 12, wherein each of the crests and troughs for the consumer side intermeshing contour longitudinally extends in a bag width-wise direction along the zipper.

14. The reclosable zipper of claim 12, where:

the intermeshing contours in the second profile are shifted in a bag height-wise direction relative to intermeshing contours in the first profile;

whereby when the first consumer side intermeshing contour is positioned against the second consumer side intermeshing contour, crests and troughs in the first consumer side intermeshing contour are capable of intermeshing with respective trough and crests in the second consumer side intermeshing contour.

15. A reclosable bag comprising:

the reclosable zipper of claim 14;

a first bag panel disposed on an exterior side of the first profile and a second bag panel disposed on an exterior side of the second profile; and a product side pouch extending away from in the zipper in a bag height-wise direction.

16. The reclosable bag of claim 15, wherein the first and second profiles are thicker than respective first and second bag panels.

* * * * *